US006667464B2

(12) United States Patent
Ellis

(10) Patent No.: US 6,667,464 B2
(45) Date of Patent: Dec. 23, 2003

(54) WARMING, SCENTING AND MUSIC PLAYING CABINET FOR BABY CLOTHES/ TOWELS

(76) Inventor: Renee S. Ellis, 1764 Hampton Oaks Dr., Fayetteville, NC (US) 28314

( * ) Notice: Subject to any disclaimer, the term of this patent is extended or adjusted under 35 U.S.C. 154(b) by 0 days.

(21) Appl. No.: 10/188,997

(22) Filed: Jul. 5, 2002

(65) Prior Publication Data

US 2003/0015513 A1 Jan. 23, 2003

Related U.S. Application Data

(60) Provisional application No. 60/306,154, filed on Jul. 19, 2001.

(51) Int. Cl.[7] ..... F27D 7/04; B65D 83/08; B65D 83/00; F24C 13/32

(52) U.S. Cl. ..... 219/400; 219/386; 219/201; 219/209; 219/214; 219/393; 219/414

(58) Field of Search ..... 219/385, 386, 219/393, 400, 201, 209, 214, 414

(56) References Cited

U.S. PATENT DOCUMENTS

| | | | | |
|---|---|---|---|---|
| D246,985 | S | | 1/1978 | Popma et al. |
| 4,117,309 | A | | 9/1978 | Cayley |
| D258,527 | S | | 3/1981 | Souhan et al. |
| 4,559,442 | A | | 12/1985 | Graham |
| 4,644,136 | A | | 2/1987 | Watchman |
| 4,684,787 | A | | 8/1987 | Bunting |
| D302,460 | S | | 7/1989 | Gibson |
| 4,927,995 | A | | 5/1990 | Lovett et al. |
| 5,004,894 | A | | 4/1991 | Whitehead |
| 5,231,266 | A | | 7/1993 | Warren |
| 5,318,107 | A | * | 6/1994 | Bell ..... 392/445 |
| 5,569,401 | A | | 10/1996 | Gilliland et al. |
| 5,592,750 | A | | 1/1997 | Eichten |
| D390,645 | S | * | 2/1998 | Hanrahan et al. ..... D23/332 |
| 5,736,714 | A | * | 4/1998 | Bechtold, Jr. ..... 219/521 |
| 5,842,287 | A | | 12/1998 | Murphy |
| 6,005,227 | A | | 12/1999 | Pappas |
| 6,018,145 | A | * | 1/2000 | Moreno ..... 219/401 |
| 6,046,436 | A | | 4/2000 | Hunts |
| 6,263,591 | B1 | * | 7/2001 | La Porte ..... 34/62 |

FOREIGN PATENT DOCUMENTS

| | | | |
|---|---|---|---|
| CA | 2176523 | * | 5/1996 |

* cited by examiner

*Primary Examiner*—Joseph Pelham
(74) *Attorney, Agent, or Firm*—Richard C. Litman

(57) ABSTRACT

A multi-functional cabinet for warming and adding fragrance to an infant's towel and clothing for a predetermined duration as well as providing soothing music. The cabinet is a box-shaped enclosure with a removable lid having an upper compartment for receiving towels and clothing with a sidewall pocket for receiving a fragrance such as baby powder or baby lotion, and a pair of lower compartments for housing a heating element/blower fan and a music source, such as a music box, a compact disc player or tape player. A timer is connected to the heating element, and may also be connected to the music source.

7 Claims, 3 Drawing Sheets

WARMING, SCENTING AND MUSIC PLAYING CABINET FOR BABY CLOTHES/ TOWELS

CROSS-REFERENCE TO RELATED APPLICATION

This application claims the benefit of U.S. Provisional Patent Application Serial No. 60/306,154, filed Jul. 19, 2001.

BACKGROUND OF THE INVENTION

1. Field of the Invention

The present invention relates generally to a home textile warming device. More specifically, the invention is an infant's towel and clothing warming cabinet which adds a fragrance, plays music and employs a timer for the warming period.

2. Description of Related Art

The related art of interest relates to various devices for warming and adding fragrance to baby clothes as well as playing music, but none discloses the present multidimensional invention. There is a need for automatically pre-warming and pre-scenting baby clothes and towels before giving to the infant along with soothing music. The related art will be disclosed in the order of perceived relevance to the present invention.

U.S. Pat. No. 5,231,266 issued on Jul. 27, 1934, to Joan G. Warren describes a towelette warmer apparatus comprising a watertight cylindrical bowl having a large handle with a first apertured lid for dispensing the warmed towelettes and a hinged second lid with a night light which can support a baby. The first lid contains an air freshener, vaporizer and a music box. The bowl contains insulation in an outer layer and a resistance heater which is temperature controlled. An inner vessel contains the stacked pre-packaged towelettes. The apparatus is distinguishable for requiring a peripheral heater compartment and two lids, wherein the first lid is apertured.

U.S. Pat. No. 4,684,787 issued on Aug. 4, 1987, to Larry T. Bunting describes a draped article warming or heating cabinet built into a wall comprising a door with an inside rack having a hollow shell for draping a thick fabric article. A blower warms the article by conduction and convection of heated air from a blower/heater. The base portion of, the cabinet contains various controls such as a timer, an on/off switch and a stop switch. The cabinet is distinguishable for its required rack structure.

U.S. Pat. No. 6,046,436 issued on Apr. 4, 2000, to Barry Hunts describes a towel warmer apparatus comprising an enclosure shaped as a rectangular box with a front access door. The towel is laid on a perforated shelf through which a blower supplies warm air heated by a resistance coil heater and controlled by an electrical control circuit and a timer or when the door is opened. The apparatus is distinguishable for its required perforated shelf.

U.S. Pat. No. 4,644,136 issued on Feb. 17, 1987, to Kenneth C. Watchman describes a towel warmer apparatus mounted on a wall and utilizes bathroom water for heating. The apparatus comprises a boxed housing having a hinged upper front door which automatically starts and stops the heating process. A 110 volt A.C. current is converted to 12 volt D.C. by a transformer to drive a fan motor and fan to force heated air rising from a hot water heater up into a perforated heating chamber containing a towel. The housing has vents for air intake in the bottom wall and exit of air in the top wall. Hot water flows into a coil with heating fins in the heater. The placing of a towel inside turns on a floor switch which opens up the valve for hot water, the fan, the heater, and closes off the water, etc. when the towel is removed. The apparatus is distinguishable for its required hot water heating.

U.S. Pat. No. 5,569,401 issued on Oct. 29, 1996, to Linda J. Gilliland et al. describes a collapsible insulated heating container apparatus for heating textiles comprising at least one heating element inside. The apparatus is distinguishable for its collapsible structure.

U.S. Pat. No. 5,592,750 issued on Jan. 14, 1997, to Gerard Eichten describes a portable clothing and equipment drier apparatus comprising a suitcase containing a storage section and an equipment section separated by a base plate. A plurality of perforated tubular conduit members are set up in rack configurations for drying. The apparatus is distinguishable for requiring perforated tubular conduit members.

U.S. Pat. No. 5,004,894 issued on Apr. 2, 1991, to Jimmy Whitehead describes a cloth warmer apparatus comprising an inner container holding moistened cloth wipes and heated by a light bulb under a heat shield. A rheostat controls the heat. The apparatus is distinguishable for its inner container structure.

U.S. Pat. No. 5,842,287 issued on Dec. 1, 1998, to Willard J. Murphy describes a towel warmer apparatus comprising a wall mountable cabinet having an internal vertical wall forming a hot air supplying chamber, and a warming chamber containing a tubular rack with a depending lower section with hot air outlet openings for warming a draped towel. A timer switch and thermostat control the heating period. A fan and a resistance coil heater heats the flowing air. The cabinet has a hinged cover contoured for wall mounting. A strip of fabric doused with a fabric softener solution is positioned at the outlet of the heated influent air duct. The apparatus is distinguishable for its towel draping feature.

U.S. Pat. No. 6,005,227 issued on Dec. 21, 1999, to Steve Pappas describes a towel warmer console cabinet comprising four upright posts on a screened floor for draping the towels. Heated air flows upward from the bottom and is heated by an electric heater in a side compartment which receives effluent air from the towel containing compartment. Insulation layers line the heated airway. A thermostat is located on top with a sliding transparent glass or plastic cover. The apparatus is distinguishable for its required towel draping posts.

U.S. Pat. No. 4,117,309 issued on Sep. 26, 1978, to Michael P. Cayley describes an electric towel warmer apparatus comprising a box-shaped housing having a hinged curvilinear cover and a perforated aluminum rack containing an M-shaped heater heated by electricity which is controlled by a first temperature setting thermostat and an overload safety thermostat. An on/off light is provided with the switch. The apparatus is distinguishable for not requiring an air circulating system.

U.S. Pat. No. 4,559,442 issued on Dec. 17, 1985, to Joe Graham describes a towel warmer and holder apparatus comprising a rectangular wall mounted base support with insulation between the support and two vertical heating tubes which support two groups of horizontally disposed plates having differing areas which receive the towels. The lower tube contains an electric heating element. Other embodiments include rings and rectangular shaped tubes filled with a liquid on a vertical base embedded in a wall. A home version embodiment is a rectangular aluminum housing containing a line resistance heater wire and hung from a towel rack. The devices are distinguishable for their distinctive shapes.

U.S. Pat. No. 4,927,995 issued on May 22, 1990, to Robert R. Lovett et al. describes an enclosed towel warmer apparatus comprising a wall mounted box housing having a front cover which is bottom hinged and tilts out to tilt a vertical towel holder on which a towel is hung. When the cover is closed the towel becomes sandwiched between several thin profile electric heating elements. A solenoid latch is provided. A front control panel provides touch pads and illuminated message displays. Automatic shutoff is provided in the event the warmed towel is not removed within the preset time of 15 minutes. The apparatus is distinguishable for requiring electronic controls, but lacking air circulation means.

The following design patents illustrate various external ornamental configurations of towel warming cabinets, but fail to disclose the internal structure and heating means.

U.S. Design Pat. No. 302,460 issued on Jul. 25, 1989, to Robert J. Gibson describes an ornamental towel warming cabinet comprising a rectangular cabinet with front side controls.

U.S. Design Pat. No. 246,985 issued on Jan. 17, 1978, to Vincent J. Popma et al. describes an ornamental towel warmer apparatus comprising a housing having a triangular cross-section and a slotted bottom based on a control pedestal base anchored to a wall.

U.S. Design Pat. No. 258,527 issued on Mar. 10, 1981, to Mary Souhan et al. describes an ornamental combined towel warmer and fabric dryer apparatus comprising an elongated housing with a triangular housing having vents at one end, an on/off switch and a circular vented cover at an opposite end.

None of the above inventions and patents, taken either singly or in combination, is seen to describe the instant invention as claimed.

SUMMARY OF THE INVENTION

The present invention is directed to a multi-functional cabinet for warming and adding fragrance to an infant's towel and clothing for a predetermined duration as well as providing soothing music. It is well known that an infant desiring a change of clothes and cleaning is affected by the application of an unscented cold towel or cold clothing, particularly after bathing. Therefore, this warming and sweet smelling condition of the towels and clothing contributes to the soothing of a discomforted newborn infant.

Accordingly, it is a principal object of the invention to provide a pre-warming cabinet for infant clothing and towels.

It is another object of the invention to provide a pre-warming cabinet which can add a fragrance to the pre-warmed materials.

It is a further object of the invention to provide a pre-warming cabinet having a timing control for the warming period.

Still another object of the invention is to provide a pre warming cabinet having a musical playing element.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
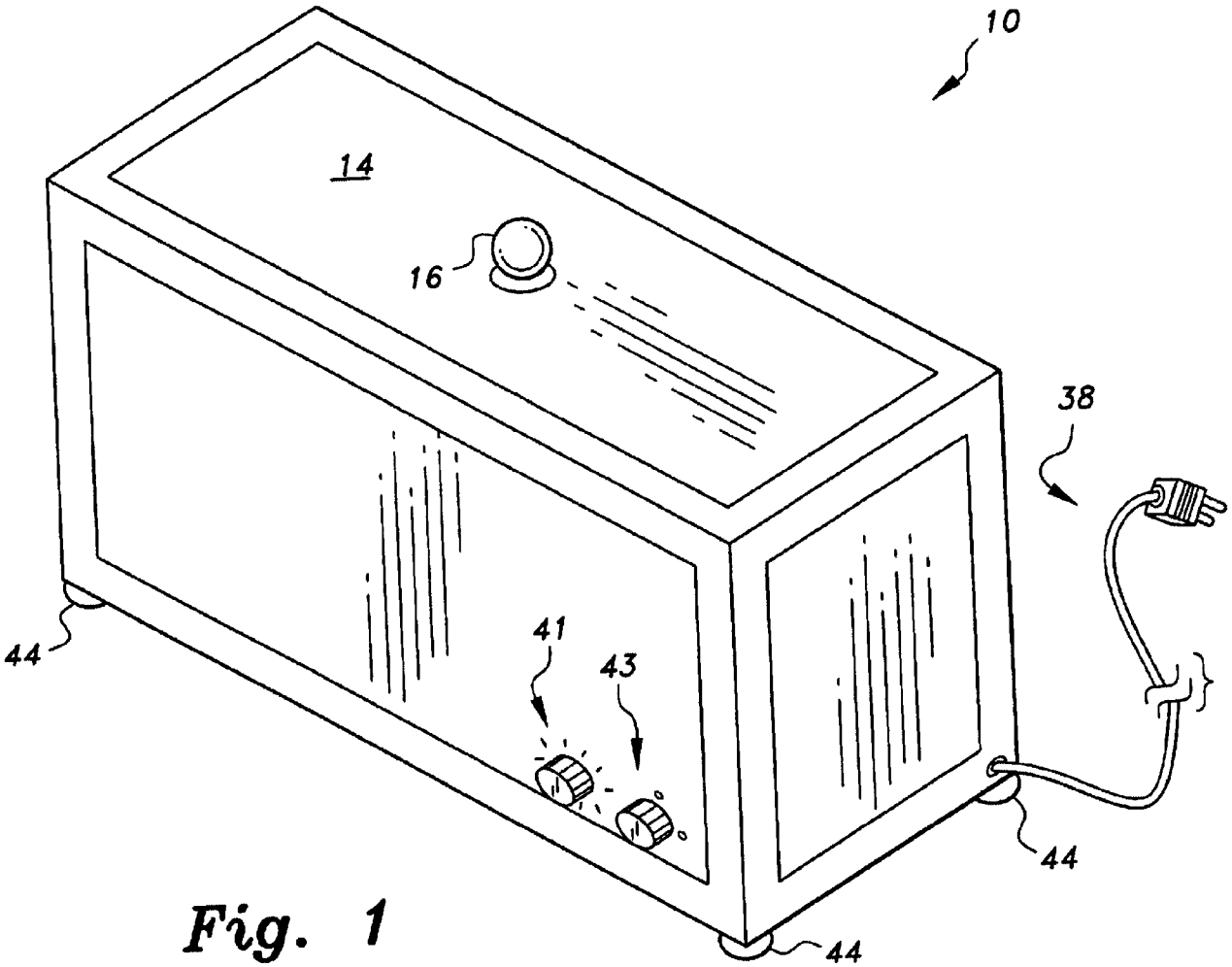
FIG. 1 is an environmental, perspective view of a scented warmer cabinet for baby clothes/towels having a lift-off lid, ball feet, a heater/blower control, and a timer control according to the present invention.
Figure 2:
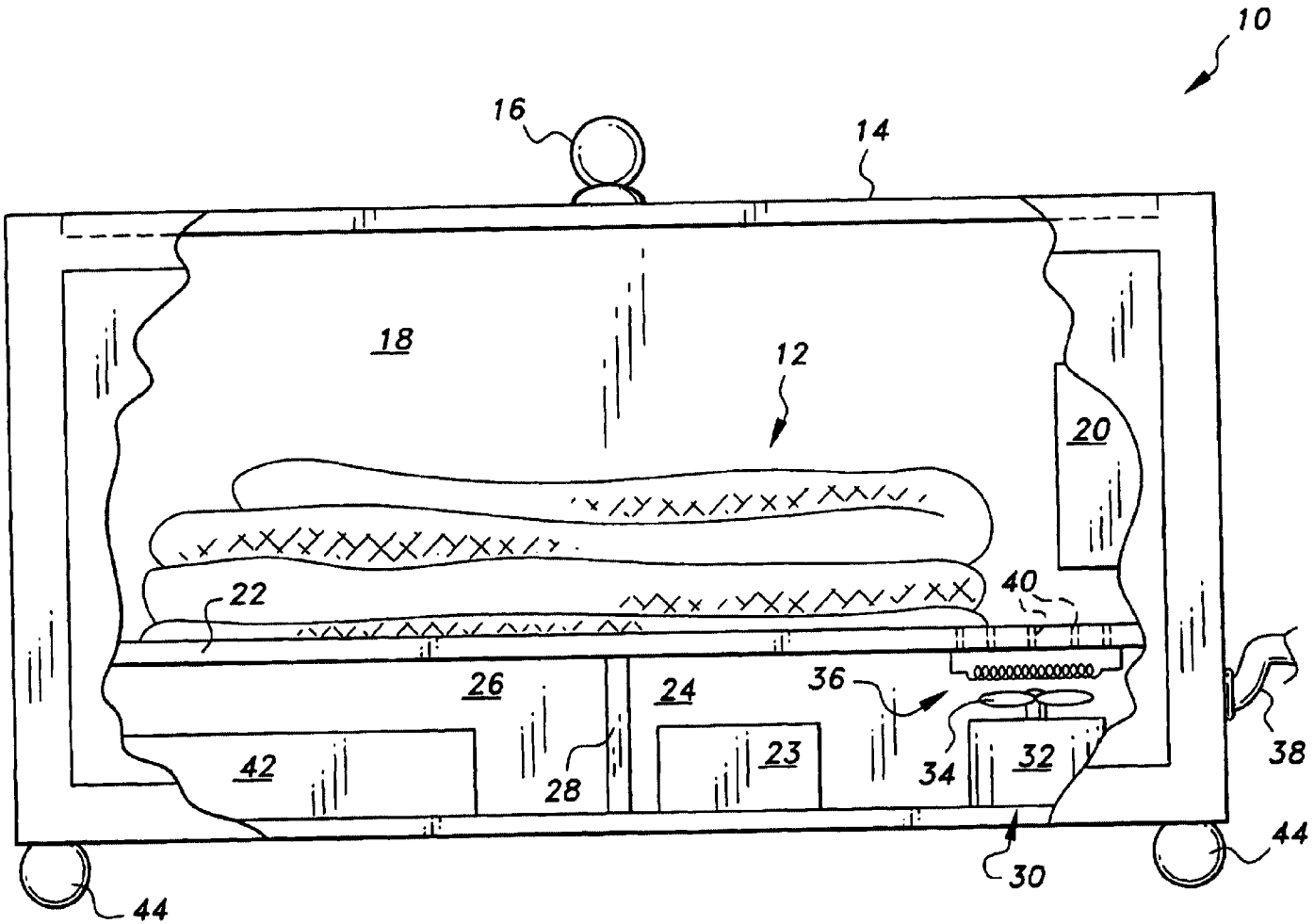
FIG. 2 is a front elevational view of the of the cabinet, partially broken away, to show the lid, the materials being heated in the cabinet, the fragrance containing pocket, a music box, a compact disc player or a cassette tape player in its compartment, and the timer and fan motor elements in their compartment.
Figure 3:
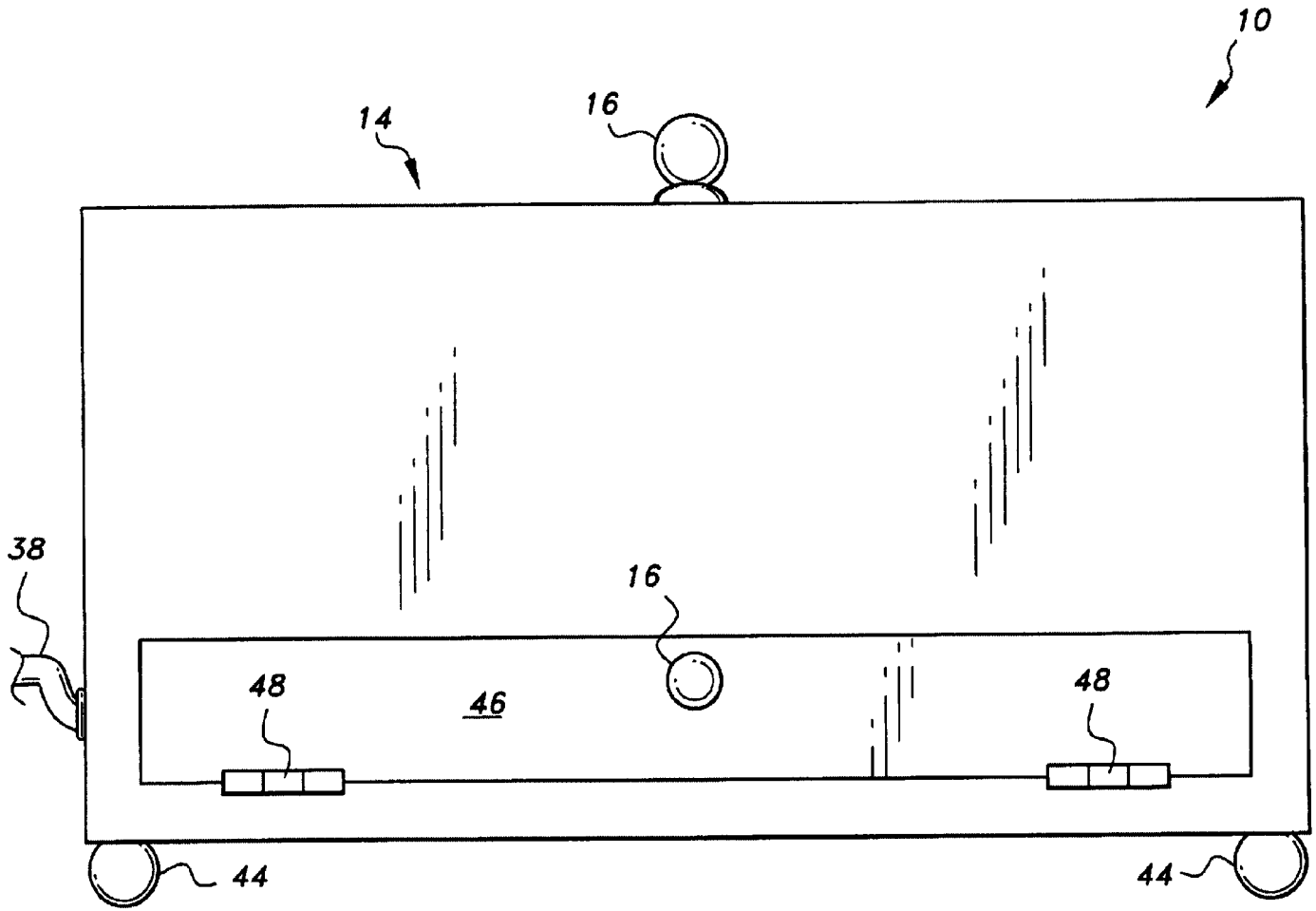
FIG. 3 is a rear elevational view of the cabinet having an access panel to the heater/blower unit, the timer unit, and the music box or cassette player.

The present invention is directed in FIGS. 1 to 3 to a cabinet 10 for pre-warming a stack of infant's towels and/or clothes 12, which also adds fragrance to the towels and plays music during the warming period, the cabinet 10 having a removable unhinged lid 14 with a knob handle 16, an upper compartment 18 for loading the infant's towels and/or clothes 12, and a sidewall pocket 20 for adding a fragrance provider, such as scented baby powder and baby lotion. The floor 22 defines the upper compartment 18 and a pair of first and second bottom compartments 24 and 26, respectively, divided by a wall 28. A heater/blower element 30 comprising an A.C. motor 32 driving a fan 34 as a blower element and an electrical resistance coil 36 as a heater element is housed in the first bottom compartment 24 and is connected to a 110 volt A.C. house current source by an electrical cord and plug 38. A timer control knob 41 and an on/off motor control knob 43 are located in the front as depicted in FIG. 1. The floor 22 contains apertures 40 over the heater/blower element 30 for circulating and recirculating the warmed air. A timer element 23 is also in the first bottom compartment 24. A music supplying means 42 such as a wind-up music box or a battery operated compact disc or tape player is housed in the second bottom compartment 26. Both the heating element 30 and the music supplying means 42 may be connected to the timer 23 so that the music plays for a predetermined period of time while the towels 12 are being warmed and shuts off to signal that the warming cycle has been completed. Consequently, the infant can be soothed by music from the music supplying means 42 and then supplied with pre-warmed, scented towels and clothing 12.

The cabinet 10 is based on four ball feet 44 located at each corner under the cabinet for elevating the cabinet to dissipate heat and eliminate the use of any insulation.

In FIG. 3, the rear view of the cabinet 10 shows an access door 46 on hinges 48 for accessing the first and second compartments 24, 26, respectively, the motor 32 and the music supplying means 42. A knob handle 16 on the door 46 enables access.

In the event of preventing possible overheating in the electrical system, a fuse having a safe amperage rating can be inserted in the electrical cord 38.

It is to be understood that the present invention is not limited to the sole embodiments described above, but encompasses any and all embodiments within the scope of the following claims.

I claim:

1. A pre-warming, fragrance adding, and music providing cabinet for an infant's towels and clothes comprising:

a box-shaped enclosure having:

a removable lid;

a bottom floor and a first floor parallel to and above the bottom floor, the first floor defining an upper compartment for loading an infant's towels and/or clothes;

a sidewall pocket disposed in the upper compartment for adding a fragrance provider;

a first bottom compartment and a second bottom compartment disposed between the bottom floor and the first floor;

a heater/blower element disposed in the first compartment; and a music supplying means for supplying music disposed in the second compartment;

wherein towels and baby clothing are warmed and scented when a fragrance source is disposed in the sidewall pocket so that an infant can be soothed by music and by scented, pre-warmed towels and clothing.

2. The cabinet according to claim 1, wherein said music supplying means is selected from the group consisting of a music box, compact disc and a tape player.

3. The cabinet according to claim 1, wherein said music supplying means is a music box.

4. The cabinet according to claim 1, wherein said music supplying means is a compact disc.

5. The cabinet according to claim 1, wherein said music supplying means is a tape player.

6. The cabinet according to claim 1, further comprising a timer connected to the heater/blower element for controlling heating of an infant's towels and clothes, the timer being disposed below the first floor of the cabinet.

7. The cabinet according to claim 1, further comprising a timer device connected to said music supplying means for timed playback of music.

* * * * *